United States Patent [19]

Sumerau

[11] 4,334,390

[45] Jun. 15, 1982

[54] BELT SANDER

[75] Inventor: Russell Sumerau, Easley, S.C.

[73] Assignee: The Singer Company, Stamford, Conn.

[21] Appl. No.: 190,544

[22] Filed: Sep. 24, 1980

[51] Int. Cl.[3] ..... B24B 23/06

[52] U.S. Cl. ..... 51/170 EB

[58] Field of Search ..... 51/170 EB, 170 R, 135 BT, 51/148

[56] References Cited

U.S. PATENT DOCUMENTS

| | | | |
|---|---|---|---|
| 2,178,865 | 11/1939 | Swan | 51/170 EB |
| 2,282,658 | 5/1942 | Kneisley | 51/170 EB |
| 2,289,481 | 7/1942 | Burleigh | 51/170 EB |
| 3,331,165 | 7/1967 | Blevins et al. | 51/170 EB |
| 3,359,689 | 12/1967 | McCarty et al. | 51/170 R |
| 3,362,111 | 1/1968 | Foell, Jr. et al. | 51/170 R |
| 3,540,161 | 11/1970 | Anton et al. | 51/170 R |
| 3,566,548 | 3/1971 | Beckering et al. | 51/170 EB |

*Primary Examiner*—Roscoe V. Parker

*Attorney, Agent, or Firm*—Edward P. Schmidt; Robert E. Smith; Edward L. Bell

[57] ABSTRACT

An electrically driven motor operated belt sander is provided having a low profile and a center of gravity close to the sanding plane by passing the belt about three generally triangularly located belt drums with the motor disposed within the belt path and the motor and support mechanism being mounted to a one-piece frame or bracket which hangs the entire drive and support mechanism from the tool housing, the one-piece frame or bracket including a wear plate or strip which provides positive protection for the wiring between the operating trigger switch and the motor.

8 Claims, 7 Drawing Figures

Fig.1
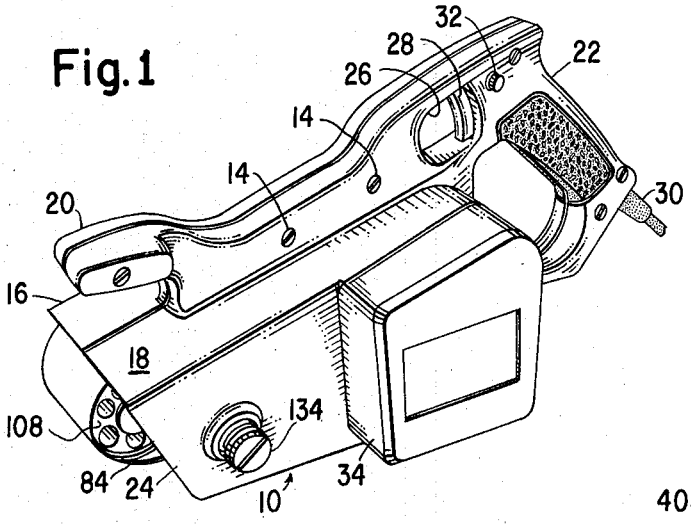
Fig.3
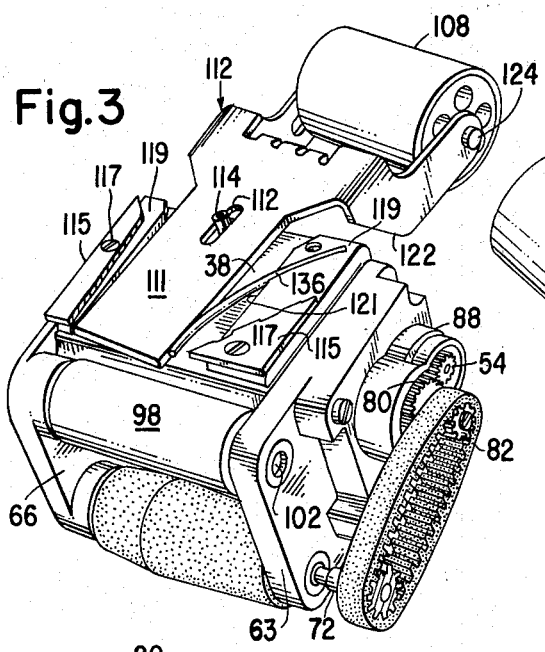
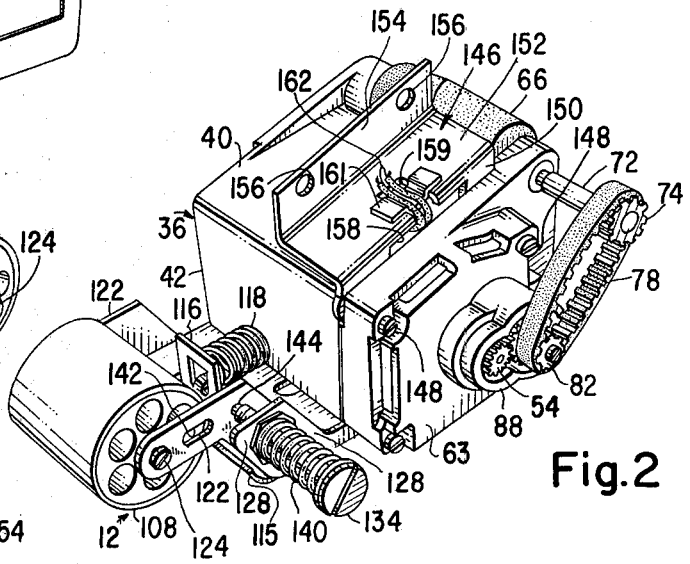
Fig.2
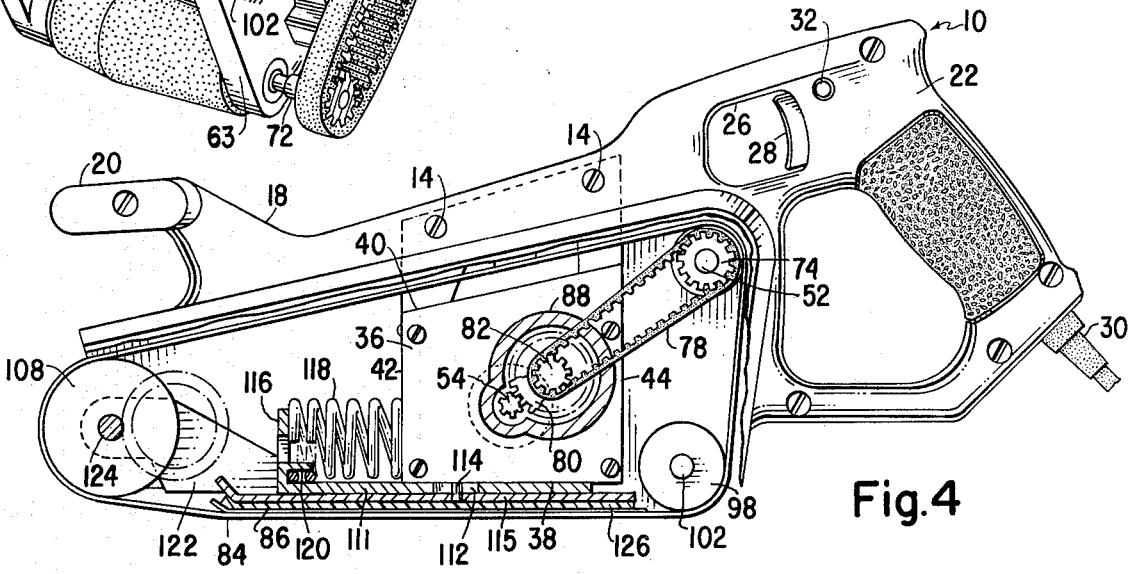
Fig.4

Fig.5
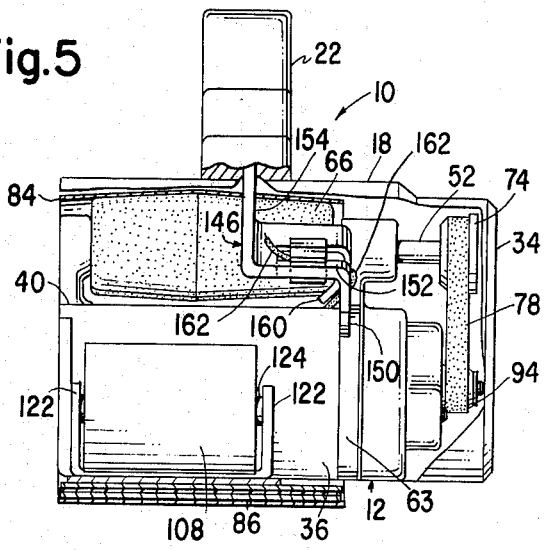
Fig.6
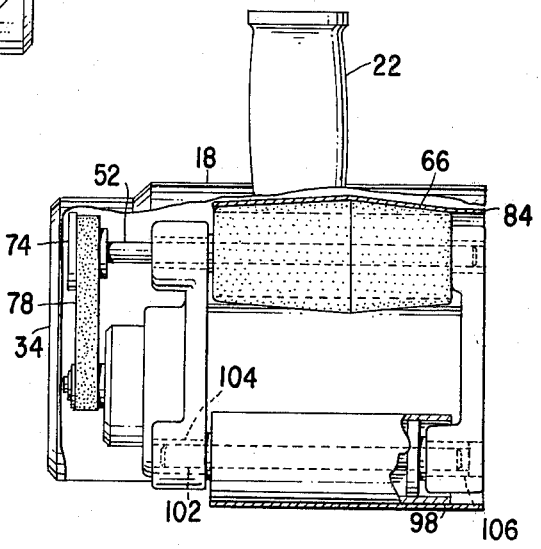
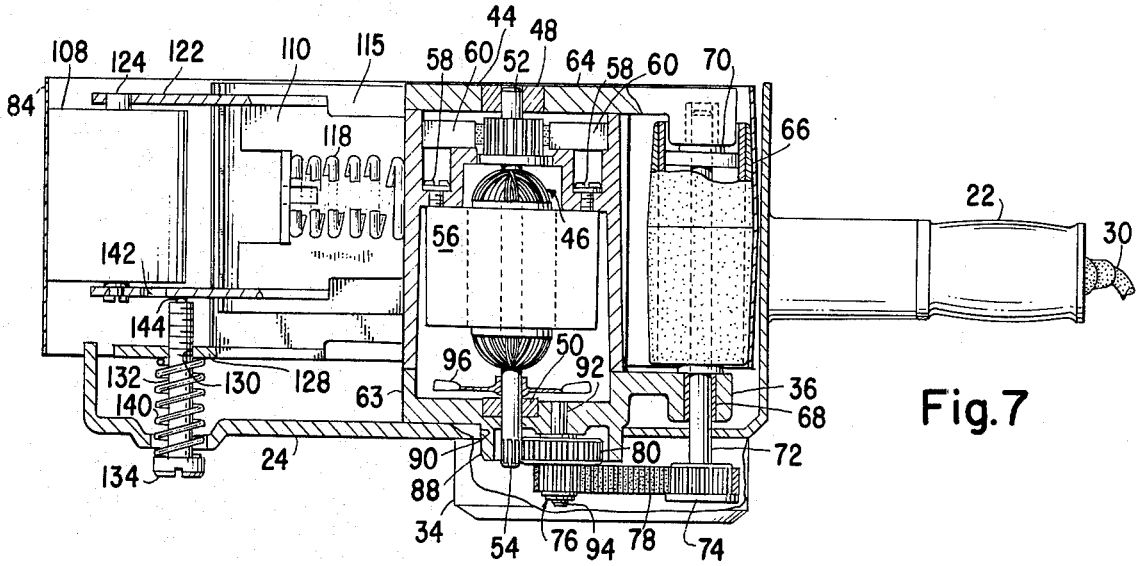
Fig.7

BELT SANDER

FIELD OF THE INVENTION

This invention relates to portable electric power tools and, more particularly, to a portable electric belt sander.

BACKGROUND OF THE INVENTION

In the prior art, it has been common for belt sanders to have a top mounted electric motor to drive a rear sanding belt drum through a timing belt. The sanding belt passes around the rear sanding belt drive drum and also around a front idler belt drum mounted on a supporting frame which may be retracted to permit changing of belts and adjusted to provide for proper tracking of the belt.

Such belt sanders having a top mounted electric motor are bulky and the center of gravity is substantially spatially removed from the sanding plane. Hence, said sanders are less stable than might be desirable in the operator's hands, and producing a flat, true surface with such machine requires substantial skill on the part of the operator.

It has been previously suggested to eliminate some of the balance problem by positioning the motor inside the path of travel of the sanding belt so as to thereby both decrease the overall height of the tool as well as to substantially lower the center of gravity.

In positioning the motor within the path of travel of the sanding belt, however, it is necessary that the electric wiring therefore, leading from the belt to the trigger switch, be well shielded from any possible contact with the edges of the sanding belt. Further, such positioning of the drive motor within the path of travel of the sanding belt reduces the amount of space available within the belt for belt tension spring means and tracking adjusting means.

OBJECTS OF THE INVENTION

Bearing in mind the foregoing, it is among the primary objects of the present invention to provide new and improved belt sanders, especially belt sanders having a low profile and a center of gravity which is close to the sanding surface, wherein the motor is within the path of travel of the sanding belt, wherein the belt tensioning and tracking mechanism is inexpensive, compact and reliable, and wherein the belt sander is economical to manufacture and durable and efficient in use.

Other primary objects of the present invention, in addition to the foregoing objects, are the provision of such novel and improved belt sanders wherein the belt supporting, tensioning, tracking and driving mechanisms comprise a modular subassembly which may be suspended from a clam shell housing handle portion having a trigger switch therein, wherein the clam shell housing may be fabricated of thermoplastic material, wherein the wiring between the trigger switch and the drive motor is positively shielded and protected from any possible contact with the sanding belt and wherein the sanding belt is exposed at one edge thereof to allow sanding of a surface flush to an adjoining surface.

Other primary objects of the present invention, in addition to each of the foregoing objects, are the provision of such belt sanders wherein a drive motor within a motor housing, an upper rear sanding belt drive drum, lower rear idler belt drum, and a support assembly for a front idler belt drum are all mounted to a one-piece frame or bracket which in turn is suspended from the housing and handle portion.

Yet still further primary objects of the present invention, in addition to each of the foregoing objects, are the provision in such a belt sander of a novel and improved idler support including an adjustable front idler pulley, roller or drum assembly adapted for mounting with such one-piece frame or bracket to bias the front idler pulley, roller or drum outwardly during normal operation and enable it to be retracted for changing the belt, the front idler support having a plate with a longitudinal slot passing under the motor housing and engaged by a roll pin extending from the motor housing to permit the longitudinal retracting motion and limited pivotal motion of the plate and front idler roller to adjust the tracking of the sanding belt on the front idler roller and/or to center the same.

Yet still other primary objects of the present invention, in addition to each of the foregoing objects, is the provision of such an idler support which is economical yet easily moved to a retracted position, and wherein upon retraction of the idler support it will be pivoted toward the sidewall to be latched in the retracted position, wherein such latching is achieved by engagement of the tracking adjustment screw, whereby such latching is achieved at minimal expense and with minimal additional components, and wherein a leaf spring biases such support towards such tracking adjustment screw.

Another and yet still further primary object of the present invention, in addition to each of the foregoing objects, is the provision in such a support mechanism and one-piece frame of a wear strip which is sloped to permit the edge of the sandpaper belt to ride up a limited amount without damage thereto during adjustment or upon misalignment of the tracking mechanism, protecting the wiring and the sander housing from abrasion by the sanding belt.

The invention resides in the combination, construction, arrangement and disposition of the various component parts and elements incorporated in improved belt sanders constructed in accordance with the principles of this invention. The present invention will be better understood and objects and important features other than those specifically enumerated above will become apparent when consideration is given to the following details and description, which when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved especially if they fall within the scope and spirit of the subjoined claims.

SUMMARY OF THE INVENTION

In accordance with the present invention, an electrically driven motor operated belt sander is provided having a low profile and a center of gravity close to the sanding plane by passing the belt about three generally triangularly located belt drums, an upper rear driving belt drum, a lower rear idler belt drum disposed generally perpendicularly beneath the driving belt drum, and a nose idler belt drum which is spring biased in a forward direction to provide tensioning to the belt. The nose drum is carried on a support mechanism providing the outward biasing during normal operation and retractable for changing of the belt and including a plate with a longitudinal slot passing under the motor and engaged by a roll pin extending from the motor housing to permit the longitudinal retracting motion and limited pivotal motion of the plate and nose idler drum support. The support plate is turnable to adjust the tracking of the idler support and/or to center the same, being spring biased against a tracking adjustment screw. Upon retraction of the nose idler drum support, it is pivoted toward the tracking adjustment screw by the biasing spring and latched thereby in the retracted position. The motor is disposed within the belt path and the motor and support mechanism are mounted to a one-piece frame or bracket intermediate the drive and nose idler drums which hangs the entire drive and support mechanism from the tool housing. Further, the one-piece frame or bracket includes a wear plate or strip having a portion bent outwardly thereof towards the belt which is sloped to permit the edge of the sandpaper belt to ride up a limited amount without damage thereto during adjustment or upon misalignment of the tracking mechanism of the belt sander and the wear plate or strip further provides positive protection for the wiring between the operating trigger switch and the motor, positively preventing any contact thereof by the sanding belt.

DESCRIPTION OF THE DRAWINGS

While the specification concludes with claims particularly pointing out and distinctly claiming the subject matter which is regarded as forming the present invention, it is believed the invention will be better understood from the following detailed description when taken in conjunction with the annexed drawing wherein like reference characters are used for similar parts throughout the various views and which discloses, illustrates and shows a preferred embodiment or modification of the present invention and what is presently considered and believed to be the best mode of practicing the principles thereof and wherein:

FIG. 1 is a perspective illustration of an improved low profile belt sander constructed in accordance with the principles of the present invention;

FIG. 2 is a perspective illustration similar to FIG. 1 of the operating mechanism, comprising the motor, drive system and belt drive and support drums, including an upper rear belt drive drum, a lower rear belt idler drum, and an outwardly biased nose belt idler drum and a support mechanism therefore, all mounted on a frame and defining a belt support and drive module for suspension from the housing as shown in FIG. 1, which has been removed in FIG. 2;

FIG. 3 is a view of the module of FIG. 2, inverted and partially broken away;

FIG. 4 is an enlarged side elevational view of the belt sander of FIG. 1, partially broken away;

FIG. 5 is an end elevational view, with the housing partially broken away, as viewed generally from the left of FIG. 4;

FIG. 6 is an end elevational view of the belt sander of the preceding figures, viewed from the right end of FIG. 4, with the housing partially broken away; and FIG. 7 is a cross-sectional plan view of the sander of the present invention looking down on the belt sander and broken away generally along a line extending from above the nose idler drum, rotating so as to bisect the timing belt drive, and through the handle and the housing to illustrate the drive train and belt tensioning and adjusting mechanism.

DETAILED DESCRIPTION OF THE INVENTION

With reference now to the drawing, there is shown and illustrated a portable electric motor driven belt sander constructed in accordance with the present invention and designated generally by the reference character 10. The sander 10 comprises a unitary belt support and drive module assembly, shown in perspective in FIGS. 2 and 3, with the housing removed, and designated generally by the reference character 12, which is supported or hung from a pair of screws 14 which pass through and aid in holding together a pair of clam shell housing members 16 and 18. The housing members 16 and 18 are integrally formed of thermoplastic material to define a front handle 20, a rear handle or hand grip 22, and a belt guard 24. Adjacent the rear hand grip handle 22, there is provided a trigger opening 26 having slidable therein a trigger switch control 28 to enable the tool or sander 10 to be energized from a power line 30. The trigger switch control 28 may also be provided with a lock-on button 32, for latching the trigger switch control 28 in the "on" position.

The housing members may be defined, for convenience in description, by calling the housing half 16 a housing support half and the housing member portion 18 a housing cover half. Yet further, the housing may comprise a gear cover 34 mounted on the housing cover half 24.

The belt support and drive module assembly 12 comprises a motor housing 36 of generally trapezoidal configuration having a base surface 38, a sloping upper surface 40, a relatively low front surface 42, and a relatively higher rear surface 44. An armature assembly 46 is journaled within the motor housing 36 in bearings 48 and 50. The armature assembly 46 includes an armature shaft 52 which extends outwardly through the motor housing 36 with the outboard end portion thereof being provided with teeth to form a drive pinion gear 54.

Also mounted within the motor housing 36 is a field assembly 56 held in position therein, as by means of mounting screws 58. Yet still further, within the motor housing 36 there is provided a pair of brush assemblies 60 cooperating with a commutator 62 carried by the armature shaft 52. The motor housing 36 is closed at the end adjacent the gear 54, as by means of a first motor housing cover 63 and at the end opposite the gear 54, as by means of a motor housing cover 64.

The motor housing 36, in addition to carrying the armature assembly 46, also carries a driving belt drum or drive roller 66 which is journaled within a pair of bearings 68 and 70 carried by the motor housing 36 and motor housing cover 64, respectively. The drive roller 66 includes an axle shaft 72 which extends into the bearing 70, through the drive roller 66, and through the bearing 68 and carries on its outboard end portion a toothed pulley 74, the toothed pulley 74 and drive roller 66 both being fast on the axle shaft 72.

In driving relationship between the motor armature shaft 52 and the drive roller shaft 72, there is provided a double reduction gear train which includes as an input gear, the gear teeth 54 on the motor armature shaft 52. The gear train also comprises the pulley gear 74 on the drive roller shaft 72 as an output, together with an intermediate gear cluster designated generally by the reference character 76 and a timing belt 78. The intermediate gear cluster 76 comprises coaxial, integral gear members comprising an input gear member 80 meshed with the gear teeth 54 of the motor armature shaft 52 and an output gear 82, of smaller diameter rotating therewith and meshed with the teeth of the timing belt 78. The timing belt 78 is also in mesh with the pulley gear 74 fast on the drive roller shaft 72. Hence, upon rotation of the motor armature shaft 52, the drive roller 66 will be powered, to pull the sanding belt 84 through the sanding area defined beneath a wear plate 86 also forming part of the belt support and drive module assembly 12. Surrounding the armature gear 54 and the gear member 80, integrally formed with the motor housing 36 is a motor housing extension 88 which extends through an aperture 90 provided in the housing guard portion 24, as shown, particularly in FIG. 7. The gear cluster 76, as shown, is supported on a stub shaft 92 and held thereon, as by means of an "E" ring 94 engaged in a groove in the stub shaft 92. Additionally, the armature shaft 52 carries a cooling fan 96.

The drive roller 66, as shown, is positioned generally at the upper rear of the belt support and drive module assembly 12. In addition to the drive roller 66, the sanding belt 84 also passes around a lower idler roller 98 which is journaled on an axle 102 whose end portions are supported in bearings 104 and 106 carried, respectively, in the motor housing 42 and motor housing cover 44, respectively. The idler roller 98, as shown, is generally beneath the drive roller 66. Yet further, the belt support and drive module assembly 12 comprises a nose idler pulley or drum 108 which is journaled for rotation on a shaft 110 carried on a support mechanism designated generally by the reference character 112 which is biased outwardly during normal operation of the belt sander 10 and retractable for changing the belt 84. The idler support mechanism 112 comprises a supporting plate or base 111 which is provided with a longitudinal slot 112 and which passes under the motor. A roll pin 114 is engaged in a hole in the bottom 38 of the motor housing 36, passes through the slot 112 and is also engaged in a hole provided in a base plate or shoe 115, extend beneath and secured with the motor housing 42, as by means of a plurality of flathead machine screws 117. The bottom wall 38 is provided with a pair of spaced apart, longitudinally extending bosses 119, defining therebetween a longitudinal slot 121 so that the support plate 111 may slide longitudinally back and forth between the base plate 115 and the motor housing 42 within the slot 121. This construction restrains the plate 111 for its retracting motion and permits limited pivotal motion to allow for adjustment of the tracking of the sanding belt 84 and for latching the support plate in a retracted position as will be described hereinafter.

The idler support 112 further comprises an upwardly extending spring mount 116 and a compression coil spring 118 is positioned between the spring support mount 116 and the forward wall 42 of the motor housing 36, being retained in position, as by means of a tang 120 also formed as part of the idler support 112. Yet still further, the idler support 112 comprises a pair of upwardly extending side walls or support arms 122 through which a shaft 124 passes and is supported and upon which the nose idler roller or drum 108 is journaled for rotation.

Between the support plate or shoe 115 and the wear plate 86, there is provided an elastomeric backing pad 126 to provide a slight amount of give to the wear plate 86. Further provided on the support plate or shoe 115, is an upstanding support arm 128 generally spaced apart from one of the idler nose roller support arms 122. The support arm 128 is provided with a threaded aperture 130 through which there extends a threaded shaft or tracking screw 132 provided on its outboard end portion with a control knob 134 which preferably has a knurled periphery. The inner end portion of the threaded shaft 132 abuts the nose roller support arm 122 so as to push the nose roller 108 sideways, away from the support arm 128. This sideward thrust is counterbalanced by means of a leaf spring 136 carried by the motor housing 36, as by being cantilevered from the boss 119 into the slot 121 (see FIG. 3) and abutting an edge of the idler support plate 111. Between the support arm 128 and the knob 134, there is provided surrounding the threaded-shaft or tracking screw 132, a compression spring 140.

The roller support arm 132 adjacent the threaded shaft or tracking screw 132 is provided with an elongated slot 142. The end of the threaded shaft 132 adjacent the idler support arm 122 is provided with an annular shoulder to define a reduced diameter tip portion 144 adapted to fit within the elongated slot 142 when the idler support roller is in the retracted position. In order to retract the idler support roller 108, the operator need merely press backwardly thereon, against the biasing of the compression spring 118, until the elongated slot 142 is aligned with the reduced diameter portion 144 of the threaded shaft 132, whereupon the idler support 110 will pivot slightly towards the threaded shaft 132 under the influence of the leaf spring 136 so that the reduced diameter tip 144 of the threaded shaft 132 may be engaged within the elongated slot 142, locking or latching the idler support in its retracted position and enabling the sanding belt 84 to be readily replaced. After a new belt is installed, a slight twisting motion to the nose idler roller 108 away from the threaded shaft 132 will effectively release the idler support assembly 112 and enable the compression spring 118 to tighten the nose idler roller 108 against the sanding belt 84.

As heretofore pointed out, the belt support and drive module assembly 12 is hung by means of the support screws 14 from the housing portions 16 and 18. In order to provide such mounting, the belt support and drive modular assembly 12 further comprises a combined wear strip and support bracket 146 held to the motor housing 36, as by being positioned between the motor housing 36 and the cover 63 and being supported thereto, as by means of screws 148. The wear strip and bracket 146 is of general zig-zag configuration comprising a first generally vertical wall portion 150 extending into the motor housing 36 generally perpendicular the armature shaft 52 and inside the cover 63, a generally intermediate wall portion 152 extending generally perpendicular the first wall portion 150 and in spaced apart relationship to the top surface 40 of the motor housing 36 and a third wall portion 154 generally parallel and spaced apart from the first wall portion 150 extending upwardly away from the motor housing 36. The third wall portion 154 is provided with a pair of apertures 156 through which the mounting screws 14 may pass. As pointed out above, the intermediate portion 152 is spaced apart from the top wall 40 of the motor housing 36. The sanding belt passes through this space. The wall portion 50 is provided with an opening 158 and the tab 160 (see FIG. 5) bent therefrom is bent angularly into the space between the intermediate wall portion 152 and top surface 40 of the motor housing 36 to provide a ramp surface against which the edge of the sanding belt 86 may engage if tracking of the belt is not completely accurate. This tab or wear strip portion 160 will prevent any damage to the motor housing 36 or tool housing portion 18. Further, the wires 162 from the motor pass behind the tab 160 and through the opening 158. Adjacent the opening 158, the intermediate wall portion 152 is provided with a perpendicular slot 159 and a generally U-shaped wire guard 161 is disposed therein, providing a protected channel through which the wires 162 may be directed upwardly to the trigger switch 28. Hence, the wires 162 are protected by the wear strip or tab portion 160 and wire guard 161 from any possible contact by the belt 86.

The tracking of the belt 86 can be adjusted by lateral pivotal movement of the idler support 110 under the influence of the threaded shaft or tracking screw 132 and adjustment knob 134 against the biasing of the leaf spring 136.

While the invention has been described, disclosed, illustrated and shown in terms of a preferred embodiment or modification, such other embodiments or modifications as may be suggested to those having the benefit of the teachings herein are intended to be reserved, especially as they fall within the scope and breadth of the claims here appended.

I claim:

1. A portable electric belt sander comprising a combined housing and handle assembly of clam shell construction of mating housing and handle cover halves, defining a hand grip area for the operator's hand and carrying a trigger switch adjacent said hand grip portion, and a self-contained belt support and drive module assembly connected therewith, said belt support and drive module assembly being of generally trapezoidal configuration and including a belt drive roller at an upper rear position, a belt idler roller at a lower rear position, and a spring biased nose idler roller with a drive motor therebetween together with a combined wear strip and support bracket extending generally upwardly therefrom adapted to be engaged between the housing and handle cover halves and secured thereto by fastener means extending through said housing and handle cover halves and said support bracket and wear strip.

2. Belt sander defined in claim 1 wherein said belt support and drive module assembly comprises a generally trapezoidal motor housing between said rollers and wherein said combined support bracket and wear strip is of generally zig-zag configuration, comprising a first generally vertical wall extending generally perpendicular the motor armature shaft, an intermediate wall portion extending generally perpendicular said first wall portion and spaced apart from the top wall of said motor housing, and a third wall portion extending generally perpendicular said intermediate wall portion and parallel said first wall portion and provided with at least one aperture therethrough for passage therethrough of said fastening means.

3. Belt sander defined in claim 2 wherein said first wall portion is provided with an aperture therein formed by a bent tab extending angularly therefrom into the space between said intermediate wall portion and said top surface of said motor housing defining a wear strip against which the sanding belt may be engaged during adjustment of the belt upon misalignment of the tracking thereof.

4. Belt sander defined in claim 3 wherein the motor wiring exits said motor housing behind said wear strip tab so as to be protected thereby from engagement by the sanding belt.

5. Belt sander defined in claim 4 wherein said intermediate wall portion is provided with a perpendicular slot generally adjacent said aperture and further comprising a generally U-shaped wire guard inserted in said slot, the wiring being routed through said wire guard.

6. Belt sander defined in claim 3 wherein said nose idler roller is rotationally carried by a pair of spaced apart arms extending upwardly from a support plate extending beneath said motor housing, said support plate further comprising an upwardly extending spring mount generally parallel the front wall of said motor housing, said support plate being slidable relative said motor housing and a compression spring disposed between said upwardly extending spring mount and said front wall of said motor housing for tensioning said nose idler roller against the inside of the sanding belt.

7. Belt sander defined in claim 6 further comprising a shoe plate disposed beneath said support plate and mounted to said motor housing, said shoe plate being provided with an upstanding support arm extending upwardly generally parallel one of said nose idler support arms, said upstanding support arm carrying a threaded tracking screw shaft, one end of which abuts against said one of said nose idler support arms to urge said support arms pivotally relative said motor housing for adjustment of the belt tracking, said support plate being biased by a spring engaged thereagainst urging said one of said nose idler support arms against said threaded tracking screw shaft.

8. Belt sander defined in claim 7 wherein said one of said nose idler support arms is provided with an elongated slot generally adjacent said threaded shaft so that upon retraction of said nose idler roller the adjacent end of said threaded shaft may be engaged within said elongated slot to latch the assembly in the retracted position.

* * * * *